US005522905A

United States Patent [19]

Krutzsch et al.

[11] Patent Number: 5,522,905

[45] Date of Patent: Jun. 4, 1996

[54] DIESEL FUEL CONTAINING AN ADDITIVE WHICH IMPROVES THE COMBUSTION OF SOOT

[75] Inventors: Bernd Krutzsch, Plochingen; Günter Wenninger, Stuttgart; Ekkehard Lindner, Tübingen; Michael Pabel, Rottenburg-Oberndorf, all of Germany

[73] Assignee: Daimler-Benz AG, Germany

[21] Appl. No.: 31,912

[22] Filed: Apr. 16, 1993

Related U.S. Application Data

[63] Continuation of Ser. No. 812,001, Dec. 23, 1991, abandoned.

[30] Foreign Application Priority Data

Dec. 21, 1990 [DE] Germany ..... 40 41 127.3

[51] Int. Cl.[6] ..... C10L 1/18

[52] U.S. Cl. ..... 44/385; 44/436; 44/450; 44/451

[58] Field of Search ..... 44/385, 436, 450, 44/451

[56] References Cited

U.S. PATENT DOCUMENTS 2,642,344 6/1953 Livingston .
4,668,247 5/1987 Berenyi ..... 44/385

FOREIGN PATENT DOCUMENTS 0572456 3/1959 Canada ..... 44/450
2436364 2/1975 Germany ..... 44/385
2232613 12/1990 United Kingdom .

*Primary Examiner*—Jacqueline V. Howard
*Attorney, Agent, or Firm*—Evenson, McKeown, Edwards & Lenahan

[57] ABSTRACT

A diesel fuel containing an additive which improves the combustion of soot, for reducing the pollutant emission in the combustion exhaust gases from diesel engines by discontinuous burning-off of soot which has been precipitated in the exhaust gas filter, is described. For this purpose, a lithium, sodium or potassium salt of an aliphatic or aromatic alcohol, of a phenol, of an aliphatic acid or of a naphthoic acid, phenylacetic acid or cinnamic acid is added, singly or as a mixture, to the diesel fuel before the combustion of the latter in the internal combustion engine. As a result of the addition of the alkali metal salts, the ignition temperature of the soot precipitated in the particle filter is reduced, and the soot is oxidized at a temperature which is considerably lower than the normal ignition temperature. The regeneration range for the particle filter is therefore reached much more frequently in real running practice. This avoids a critical filter loading with soot, which can lead to filter damage during burning off. A further advantage of the process described is that, according to present knowledge, no additional substances with a health risk are emitted during running as a result of the addition of these alkali metal salts to the diesel fuel.

9 Claims, 3 Drawing Sheets

*FIG. 5*

EFFECTIVENESS OF THE ADDITIVES

| QUANTITY OF THE ADDITIVE | ENGINE RUNNING MODE | | | |
|---|---|---|---|---|
| | EQUILIBRIUM | $T_{exh.g.}$ = 200°C | 120°C<$T_{exh.g.}$ > 180°C | 200°C<$T_{exh.g.}$ < 400°C |
| | p UPSTREAM OF FILTER = CONST. (1) | (2) | (3) | (4) |
| ohne ADDITIV | ABOUT 560° C a) | 1.) | 1.) | 1.) |
| 0.24 mmol LITHIUM/1 DIESEL | ABOUT 480° C | NO REG. p < 350 MBAR | 2.) | 2.) |
| 1.2 mmol LITHIUM/1 DIESEL | ABOUT 450° C b) | GOOD REG. p < 200 MBAR | 2.) | 2.) |
| 3.37 mmol LITHIUM/1 DIESEL | < 350° C | VERY GOOD REG. p < 200 MBAR | VERY GOOD REG. c) p < 125 MBAR | VERY GOOD REG. p < 400 MBAR |
| 0.24 mmol SODIUM/1 DIESEL | ABOUT 530° C | NO REG. AT p < 350 MBAR | 2.) | 2.) |
| 1.2 mmol SODIUM/1 DIESEL | ABOUT 480° C | GOOD REG. d) p < 200 MBAR | VERY GOOD REG. p < 175 MBAR | VERY GOOD REG. p < 400 MBAR |
| 3.37 mmol SODIUM/1 DIESEL | ABOUT 450° C | VERY GOOD REG. p < 200 MBAR | VERY GOOD REG. p < 175 MBAR | VERY GOOD REG. p < 320 MBAR |

1.) NO TEST CARRIED OUT, TO AVOID FILTER DAMAGE
2.) NO TEST a) FIG. 1 ; TEST 1
b) FIG. 2 ; TEST 2
c) FIG. 3 ; TEST 3
d) FIG. 4 ; TEST 4

DIESEL FUEL CONTAINING AN ADDITIVE WHICH IMPROVES THE COMBUSTION OF SOOT

This is a continuation of our prior application Ser. No. 07/812,001, filed Dec. 23, 1991, now abandoned.

BACKGROUND AND SUMMARY OF THE INVENTION

The invention relates to a diesel fuel containing an additive which improves the combustion of soot.

In addition to the pollutants which are also formed in spark-ignition engines, diesel engines emit soot particles which, for some years, have been viewed very critically. Studies by animal experiments have shown that diesel exhaust gas has a carcinogenic potential. In 1987, diesel exhaust gas was therefore included as a carcinogenic working material in the list of maximum allowable concentrations.

To reduce the particle emission in the exhaust gases from diesel engines, it is now part of the state of the art to precipitate the particles formed during the combustion process in a downstream filter device and to oxidize them therein. Predominantly used nowadays as such filter devices are monolithic ceramic bodies of honeycomb structure or, for example, wound ceramic filters in which a yarn of ceramic fibers has been applied to perforated steel tubes. Fairly good precipitation of the soot particles is achievable by means of such filter bodies. What has not yet been satisfactorily solved is the absolutely necessary regeneration of the particle filters. Without additional measures, the soot precipitated in the particle filter is oxidized at a sufficiently fast rate only at temperatures above 600° C. In normal running of the motor vehicle, however, such high exhaust gas temperatures are only very rarely reached. With increasing filter loading, the exhaust gas back-pressure rises steeply and impairs the combustion behavior and the power of the engine to considerable extent. Above all, however, there is a risk of a filter too heavily coated with soot particles being overstressed during a regeneration by the heat released during the exothermic oxidation of soot and hence being damaged.

Various measures have already been disclosed in the state of the art, which are intended to allow a regeneration of the particle filter even at lower temperatures. For this purpose, it has been suggested to coat the ceramic support material of the particle filter with a catalytically active substance (German Patent Document DOS 3,232,729). However, the coatings hitherto used have proved to be not sufficiently effective. In addition, there are reservations on toxicological grounds against certain suggested coating substances, for example the vanadium oxide according to the specification quoted above. It is also already known to arrange an additional burner next to the particle filter, which is intended to burn the particle filter free of the precipitated soot under control. Direct heating of the particle filter is also already part of the state of the art (German Patent Document DOS 3,538,155). Likewise, it has already been described to add a catalytically active substance in a controlled amount to the exhaust gas stream for the combustion of the soot (German Patent Document DOS 3,325,391). To reduce the soot content in the diesel engine exhaust gases, organic boron compounds (German Patent Document DOS 2,340,522), which were admixed to the diesel fuel, or copper salts and ammonium salts (German Patent Document DOS 3,325,391) or perchlorates (German Patent Document DOS 3,436,351) have also already been recommended as additives, which are metered into the exhaust gas upstream of the soot filter. The results achieved thereby have, however, not been convincing and, with some of the suggested compounds, an additional pollutant emission injurious to health into the environment cannot be excluded. Thus, it is also shown by "Automobiltechnische Zeitschrift" 86 (1984) 2, page 76, left-hand column, that fuel additives for preventing an emission of soot have been developed which consist of metal-organic compounds of the alkaline earth metals or of alkaline earth metal sulphonates. It is explicitly pointed out here, however, that metal oxides were then formed in the combustion, which caused increased engine wear, and an increase in the toxicity of the exhaust gases could also not be excluded.

It is therefore an object of the invention to provide a diesel fuel containing an additive which improves the combustion of soot which is deposited on a downstream particle filter, in order to reduce the pollutant emission in the combustion exhaust gases from diesel engines by burning off the soot which has been precipitated on the particle filter, it being intended to reduce the ignition temperature of the soot, so that regeneration of the particle filter at low temperatures is possible. At the same time, the disadvantages indicated above should be avoided and, moreover, no additional pollutant emissions damaging to the environment should arise in the diesel engine exhaust gases.

According to the invention, the stated object is achieved by means of lithium, sodium, or potassium salts of organic compounds as an additive. In especially preferred embodiments, the metal salts at the following organic compounds is added, singly or as a mixture:

(a) of an aliphatic alcohol of the general formula $CH_3$—X—OH, X being an alkyl group having 1 to 8 carbon atoms, or of a compound isomeric with such an alcohol, or (b) of an aromatic alcohol of the general formula

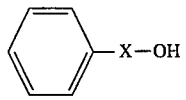

X being an alkyl group having 1 to 8 carbon atoms, or (c) of a phenol of the general formula

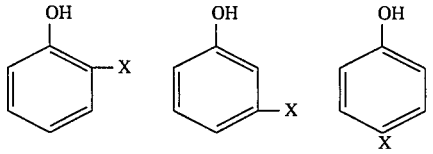

X being an alkyl group having 1 to 8 carbon atoms, or (d) of an aliphatic carboxylic acid of the general formula $CH_3$—X—COOH, X being an alkyl group having 3 to 16 carbon atoms, or of a compound isomeric with such a carboxylic acid, or (e) of 1-naphthoic acid, 2-naphthoic acid, phenylacetic acid or cinnamic acid.

In especially preferred embodiments, the metal salt added per liter of diesel fuel contains 0.1 to 50 millimole of alkali metal.

It has been found that an extremely reactive soot is formed in the diesel engine in the combined combustion of the indicated compounds with the diesel fuel. After the soot has been precipitated in the soot filter, the soot particles can be rapidly oxidized even at very low temperatures. In the studies, it has been found that the regeneration temperatures depend very greatly on the speeds and loads at which the engine is run. The engine conditions have a very great influence on the morphology of the soot and hence also the reactivity thereof. Under certain engine conditions, good regenerations of the soot filter are possible even at exhaust gas temperatures below 200° C. In contrast to the additives added to the diesel fuel according to the state of the art, there are no health reservations against the use of the alkali metal salts added according to the invention. No MAC values can be found in the literature, and there are also no indications of a potential carcinogenicity or co-carcinogenicity.

Above all for lithium compounds amongst the alkali metal salts added according to the invention, there are indications to the effect that the course of the combustion is favorably influenced and the emission is already lowered inside the engine. Above all, however, during the combustion process in the presence of the additives studied, a soot is formed which is much more readily oxidizable after precipitation in a particle filter. This has the consequence that very much lower exhaust gas temperatures suffice for the particle filter regeneration and a critical coating with masses of soot in the filter is thus avoided.

BRIEF DESCRIPTION OF THE DRAWINGS

FIG. 5 is table showing the effectiveness of various additives to diesel fuel.

In the test described below, the lithium or sodium salts of tertiary butyl alcohol were added as additives in various concentrations to the diesel fuel. The concentrations were in each case related to the quantity of alkali metal of the salt, expressed as millimole of metal, which was added to one liter of diesel fuel. The tests were carried out in a precombustion chamber diesel engine (type series DB OM 616) in stationary operation. A ceramic honeycomb monolith of cordierite was arranged in the exhaust gas line. The additives were each admixed directly to the diesel fuel before the combustion step.

The effectiveness of the additives was tested in 4 mutually different stationary and non-stationary engine running modes.

1st test:

In test 1, no additive was added to the diesel fuel.

Figure 1:
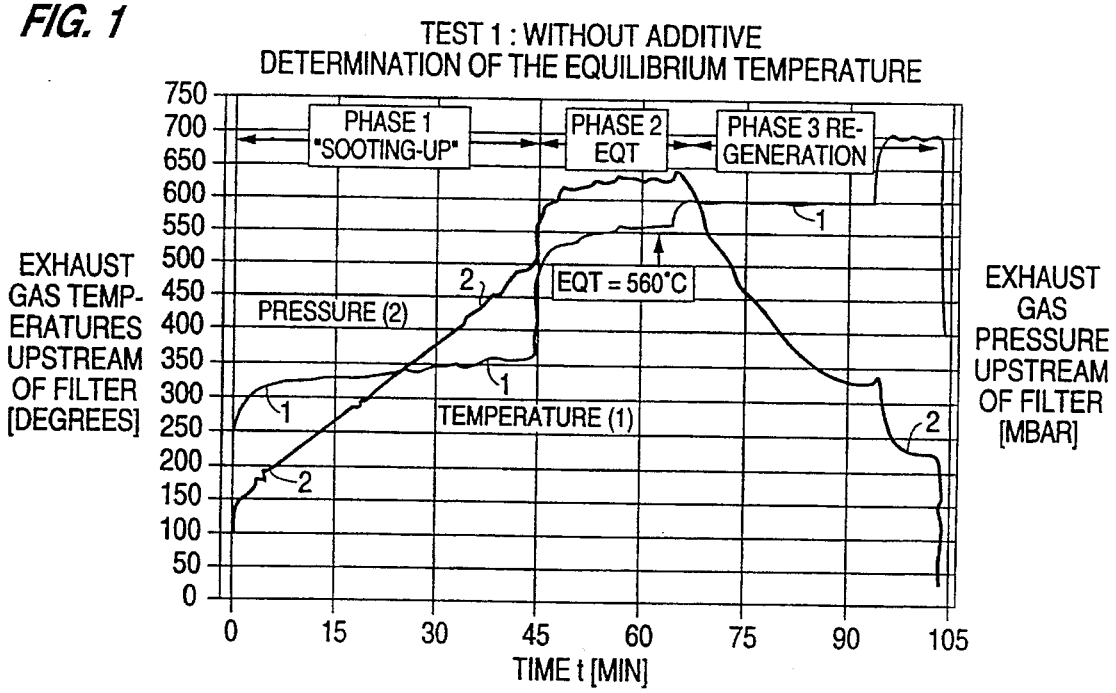
FIG. 1 is a graph showing the exhaust gas temperature and the exhaust gas pressure upstream of a filter, for a diesel fuel containing no additives carried out in a stationary engine running mode.

The test was carried out in a stationary engine running mode. Loading of the particle filter took place at an engine speed of 4,000 rpm and a mean pressure in the combustion chamber of about 1.0 bar. The exhaust gas temperature upstream of the soot filter is about 350° C. at this engine point. The particle filter was loaded until the pressure upstream of the filter had risen to 500 mbar. FIG. 1 shows the very steep pressure rise within a short time (phase 1). After the loading phase, the temperature was raised by increasing the load (phase 2). The equilibrium temperature (EQT) is reached in this test at abut 560° C. At the equilibrium temperature, the pressure upstream of the filter remains constant. The proportion of the soot newly precipitated accordingly corresponds to the proportion which is already being oxidized at this exhaust gas temperature. By raising the temperature to 600° C., the filter is then slowly regenerated (phase 3). However, the filter is completely burned free only at 700° C.

2nd test:

The following test was carried out in an engine running mode as described in test 1. The tertiary butylate of lithium, dissolved in cyclohexane, was added to the diesel fuel. The prepared solution was metered into the fuel at such a ration that 1.2 millimole of lithium were added with the metal salt per 1 liter of fuel.

Figure 2:
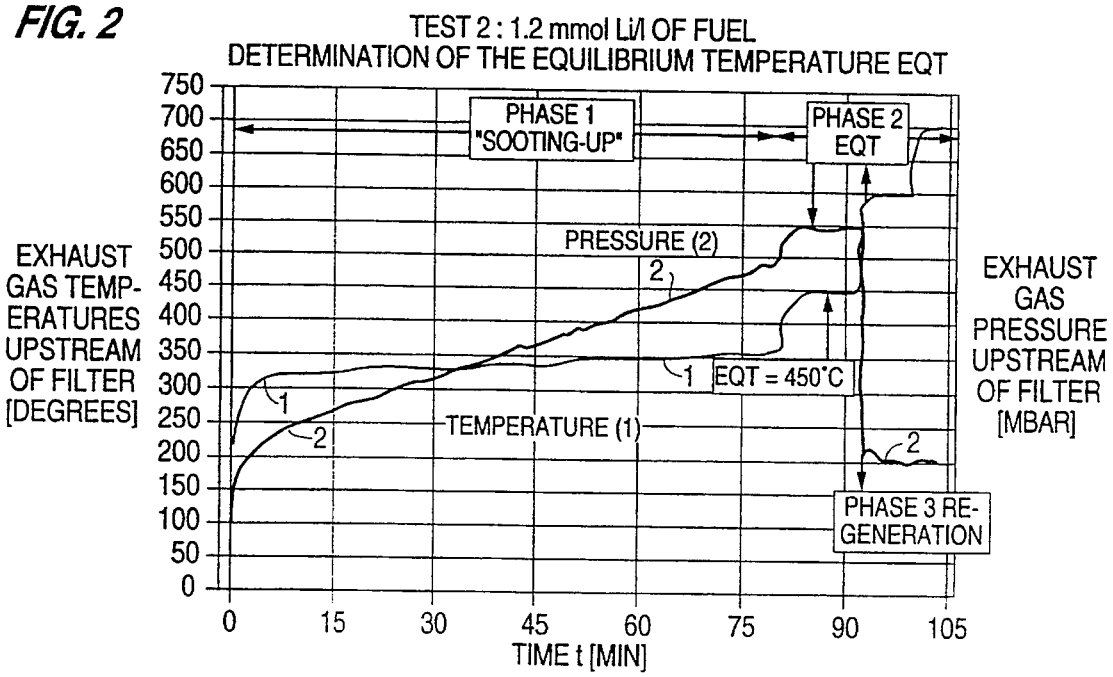
FIG. 2 is a graph showing the exhaust gas temperature and the exhaust gas pressure upstream of a filter, for a diesel fuel containing tertiary butylate of lithium, dissolved in cyclohexane, carried out in a stationary engine running mode.

As can be seen from FIG. 2, the sooting time, that is to say the time until a pressure of 550 mbar arises upstream of the particle filter, is markedly prolonged. The equilibrium temperature is now already reached at 450° C. The temperature increase to 600° C. leads to a very rapid and complete regeneration of the particle filter. The less steep pressure rise in test 2 as compared with test 1 and the very much lower blackening number might be an indication to the effect that the particle emission has already been reduced inside the engine by the addition of the fuel additive. Furthermore, it is also possible that soot already precipitated in the filter is oxidized continuously, without leading to complete regeneration.

Figure 3:
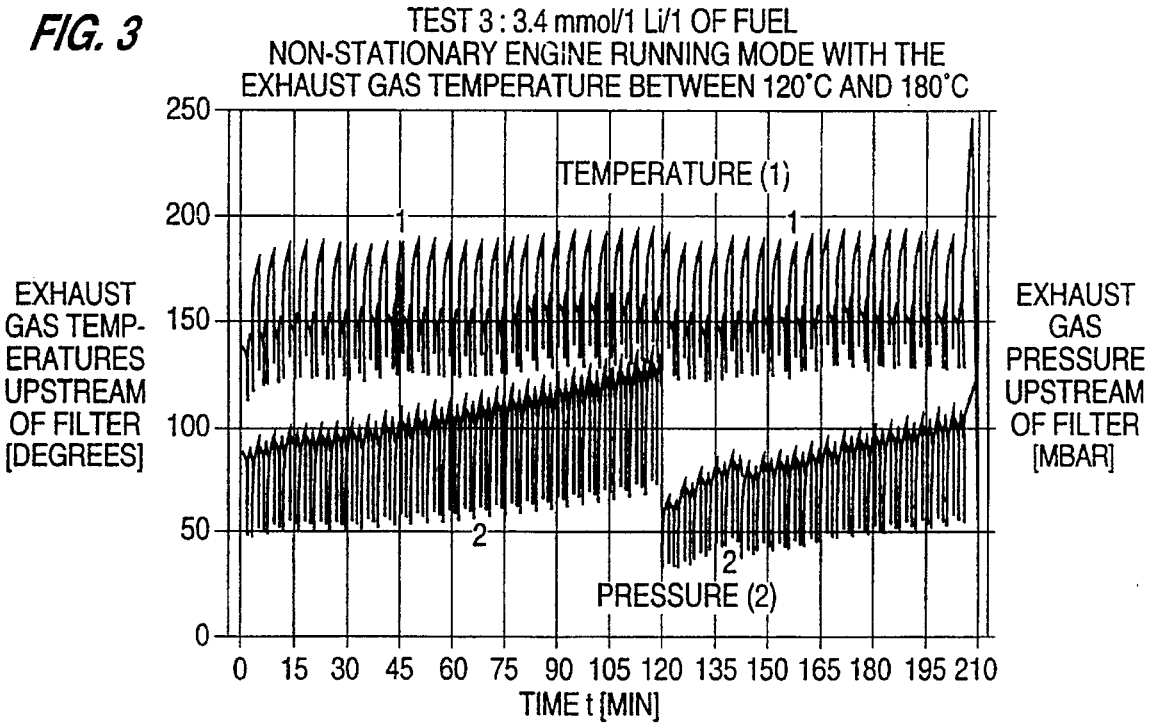
FIG. 3 is a graph showing the exhaust gas temperature and the exhaust gas pressure upstream of a filter, for a diesel fuel containing tertiary butylate of lithium, dissolved in cyclohexane, in a nonstationary mode at various speeds and loads.

3rd test:

The tertiary butylate of lithium, dissolved in cyclohexane, was added to the diesel fuel. This time, 3.4 millimole of lithium was introduced with the metal salt per 1 liter of fuel. The engine was run in the non-stationary mode at various speeds and loads with exhaust gas temperatures between 120° and 180° C. FIG. 3 clearly shows that, with this additive concentration, a regeneration of the particle filter already takes place below 200° C. at a maximum pressure of about 130 mbar upstream of the filter. This test also shows that the regeneration temperatures depend on the running mode of the engine. The exhaust gas composition and morphological particle properties have a very pronounced influence on the regeneration.

Figure 4:
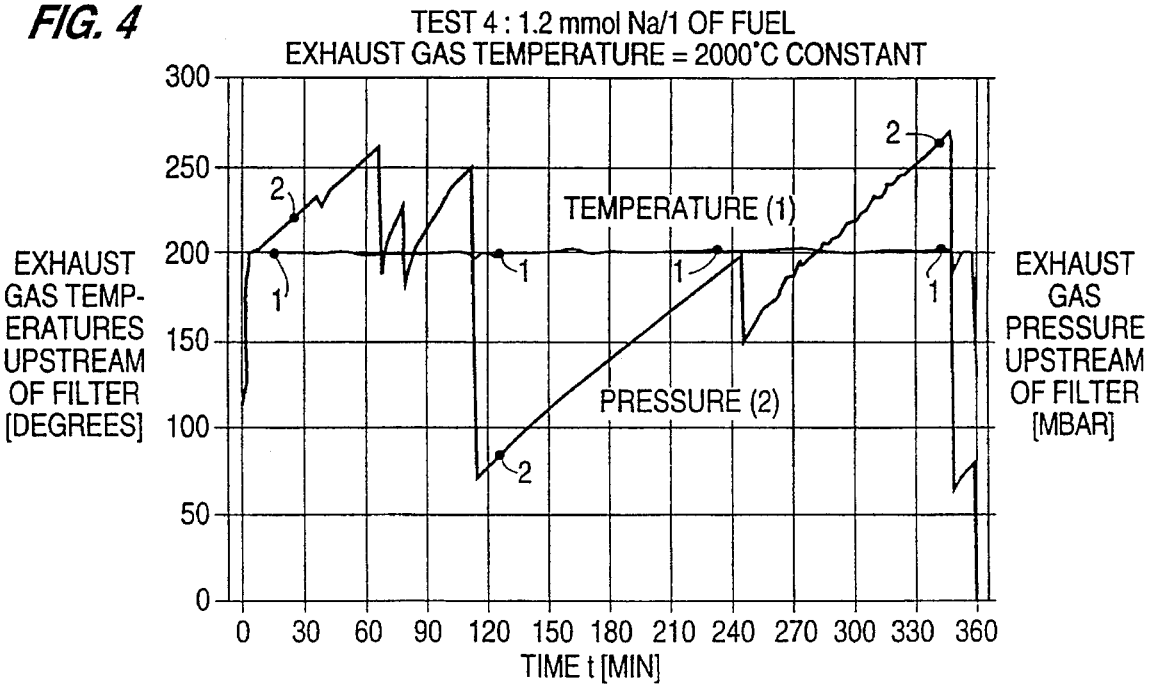
FIG. 4 is a graph showing the exhaust gas temperature and the exhaust gas pressure upstream of a filter for, diesel fuel containing tertiary butylate of sodium, dissolved in isopropanol, in an engine running at constant exhaust gas temperature.

4th test:

This time, the tertiary butylate of sodium, dissolved in isopropanol, was added as additive to the diesel fuel. The solution was metered in such a way that there was 1.2 millimole of sodium per 1 liter of fuel. In this test, the engine was run at a constant exhaust gas temperature of 200° C. upstream of the filter. It can be clearly seen from the pressure curve in FIG. 4 that the particle filter is regenerated repeatedly at 200° C. Apart from some minor regenerations in the initial phase of the test, two very vigorous regeneration steps are visible in the further course of the test, in which the particle filter is burned almost completely free of the precipitated soot. In this test, the exhaust gas back-pressure upstream of the particle filter rose to only a little above 250 mbar.

5th test:

The tertiary butylate of sodium, dissolved in isopropanol, was added to the diesel fuel. 1.2 mmol of sodium was added with the metal salt per 1 liter of fuel. The engine was run in a non-stationary mode at various speeds and loads at exhaust gas temperatures of between 200° C. and 400° C. Numerous regenerations, some of which are very vigorous, take place. The maximum pressure upstream of the filter is about 400 mbar (FIG. 5).

6th test:

The lithium salt of palmitic acid, dissolved in cyclohexane, was added to the diesel fuel. 1.2 and 3.4 mmol of lithium were introduced with the lithium palmitate per 1 liter of fuel. The equilibrium temperatures relating to the different lithium concentrations were determined correspondingly to test 1 and 2 in stationary engine running mode. The equilibrium temperature for 1.2 mmol of lithium is about 520° C., and that for 3.4 mmol of Li is about 500° C. The filter regenerations carried out at 600° C. proceed in a way comparable to lithium tertiary-butylate.

7th test:

3.4 mmol of lithium were added with the lithium palmitate to the diesel fuel. The effectiveness of the additive was determined in stationary engine running mode at exhaust gas temperatures between 200° C. and 400° C., corresponding to test 5. Numerous regenerations, some of them vigorous, take place.

The results of the tests 1 to 4 previously described are set forth once more in FIG. 5. FIG. 5 likewise shows the results of further tests carried out, in which various quantities of the tertiary butylate of lithium or sodium were added to the diesel fuel, and the regenerations of the filter under the four different engine running modes previously described.

8th test:

1.2 mmol of sodium were added with the sodium phenylethanolate dissolved in butanol to the diesel fuel. The test was then carried out under the engine running mode indicated in test 1, the equilibrium temperature being reached at 480° C. As compared with the diesel fuel to which no additive was added, the filter regeneration at 600° is markedly faster and, compared with the sodium tert.-butanolate as additive, only slightly slower.

9th test:

1.2 mmol of sodium was again added with the sodium salt of para-cresol dissolved in butanol to the diesel fuel. The effectiveness was likewise tested by the procedure described in test 1. The equilibrium temperature was about 480° C. No difference in the reaction rate was detectable in comparison with sodium tert.-butanolate.

10th test:

The lithium salt of phenylacetic acid was added to the diesel fuel. Since this compound has a substantially lower solubility in the diesel fuel than the other additives, only the lowest additive concentration of 0.24 mmol of lithium/liter of diesel fuel was tested; the test procedure was again as in test 1. The equilibrium temperature was about 520° C. There was no detectable difference in the regeneration rate as compared with lithium tertiary-butanolate, which had likewise been tested at the lowest concentration of 0.24 mmol of lithium/liter of diesel fuel.

11th test:

This test was carried out in the engine running mode described in test 1 with an engine of type OM 603 (Mercedes 300D). A sodium tertiary-butylate dissolved in butanol was added as additive to the diesel fuel, to be precise in such a quantity that 0.1 mmol of sodium was added per liter of diesel fuel. As compared with a test procedure without addition of an additive, the equilibrium temperature was lowered by about 30° C. The filter regeneration was markedly accelerated, as compared with the test procedure without additive. The test showed that an addition of 0.1 mol of sodium in the case of engine type OM 603 is just as effective as an addition of 0.24 mmol of sodium in the case of engine type OM 616. One cause might be the substantially lower emission of carbonaceous particles from the (more modern) engine type OM 603.

The tests which have been carried out show clearly how the quantity of the additives added effects the equilibrium temperature EQT (p upstream of filter=constant) under stationary engine running mode. Thus, for example, the equilibrium temperature falls from 560° C. to less than 350° C. as a result of adding 3.4 mmol of lithium per 1 liter of diesel fuel. For running practice, this means that the filter regeneration range is reached very much more frequently and a critical filter loading can be avoided.

At the same time, in non-stationary engine running mode equivalent to practice, very good regeneration of the particle filter becomes possible with a very much lower exhaust gas back-pressure than without an additive added.

The advantages of the process described are in particular that, with the metal salts of the indicated organic compounds added according to the invention to the diesel fuel before combustion, the soot precipitated in the particle filter can be oxidized at a temperature which is significantly lower than the normal ignition temperature, and the particle filter can thus be regenerated more easily. As compared with other diesel fuel additives known from the state of the art, the additional emission, which can arise as a result of adding the alkali metal compounds proposed here to the diesel fuel, can be regarded as harmless from the point of view of the environment and to health.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method of regenerating an exhaust gas filter for reducing the pollutant emission in combustion exhaust gases from a diesel engine, comprising the steps of:

providing a diesel fuel to said engine, to which fuel there has been added a metal salt of an organic compound, wherein the compound comprises a lithium, sodium or potassium salt of the following organic compounds, in the ratio of 0.1 to 50 millimole of alkali metal per liter of diesel fuel, singly or as a mixture:

1-naphthoic acid, 2-naphthoic acid, phenylacetic acid or cinamic acid; and discontinuously burning of soot which has been precipitated on the exhaust gas filter of the diesel internal combustion engine, by reducing the ignition temperature of the soot.

2. A method according to claim 1, wherein the metal salt, added per 1 liter of diesel fuel, of the organic compound contains 1.2 millimole of alkali metal.

3. A method according to claim 1, wherein the metal salt is added in solution in an organic solvent to the diesel fuel.

4. A method according to claim 1, wherein the metal salt is added to the diesel fuel immediately after the manufacture thereof.

5. A method according to claim 1, wherein the metal salt is added to the diesel fuel only just before the combustion of the latter.

6. A method according to claim 2, wherein the metal salt is added in solution in an organic solvent to the diesel fuel.

7. A method according to claim 3, wherein the metal salt is added to the diesel fuel immediately after the manufacture thereof.

8. A method according to claim 3, wherein the metal salt is added to the diesel fuel only just before the combustion of the latter.

9. A method according to claim 1, wherein a metal salt of an organic compound has additionally been added, wherein the compound comprises a lithium, sodium or potassium salt of the following organic compounds, in the ratio of 0.1 to 50 millimole of alkali metal per liter of diesel fuel, singly or as a mixture:

a) of an aliphatic alcohol of the general formula $CH_3$—X—OH, X being an alkyl group having 1 to 8 carbon atoms, or of a compound isomeric with such an alcohol, or b) of an aromatic alcohol of the general formula

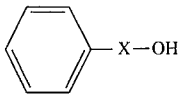

X being an alkyl group having 1 to 8 carbon atoms, or c) of a phenol of the general formula

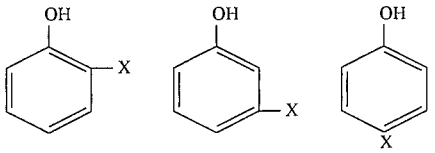

X being an alkyl group having 1 to 8 carbon atoms, or d) of an aliphatic carboxylic acid of the general formula $CH_3$—X—COOH, X being an alkyl group having 3 to 16 carbon atoms, or of a compound isomeric with such a carboxylic acid.

* * * * *